US006830127B2

(12) United States Patent
Johnson

(10) Patent No.: US 6,830,127 B2
(45) Date of Patent: Dec. 14, 2004

(54) PIPELINE CONSTRUCTION SAFETY PLATFORM

(76) Inventor: Robert Aaron Johnson, P.O. Box 963, Springville, UT (US) 84663

( * ) Notice: Subject to any disclaimer, the term of this patent is extended or adjusted under 35 U.S.C. 154(b) by 0 days.

(21) Appl. No.: 10/232,126

(22) Filed: Aug. 29, 2002

(65) Prior Publication Data

US 2004/0040784 A1 Mar. 4, 2004

(51) Int. Cl.[7] ..... A47L 3/02
(52) U.S. Cl. ..... 182/113; 182/128
(58) Field of Search ..... 182/113, 142, 182/222, 223, 128; 406/26

(56) References Cited

U.S. PATENT DOCUMENTS

| | | | | |
|---|---|---|---|---|
| 3,116,557 A | | 1/1964 | Trice, Jr. | 33/46 |
| 3,426,659 A | * | 2/1969 | Clarke | 404/25 |
| 3,591,926 A | | 7/1971 | Trice, Jr. | 33/46 |
| 3,631,601 A | | 1/1972 | McNulty | 33/46 |
| 4,142,798 A | | 3/1979 | Barbee, Jr. | 356/138 |
| 4,762,242 A | * | 8/1988 | Harris et al. | 220/484 |
| 4,776,429 A | * | 10/1988 | Osborn | 182/144 |
| 4,787,111 A | * | 11/1988 | Pacek et al. | 14/71.1 |
| 4,960,150 A | | 10/1990 | Ryan | 137/234.6 |
| 5,265,974 A | | 11/1993 | Dargie | 404/4 |
| 5,295,557 A | * | 3/1994 | Taylor | 182/222 |
| 5,547,080 A | * | 8/1996 | Klimas | 206/373 |
| 5,787,955 A | | 8/1998 | Dargie | 160/388.1 |
| 6,009,975 A | * | 1/2000 | Coenders | 182/128 |
| 6,543,584 B1 | * | 4/2003 | Miyakoshi et al. | 187/401 |

FOREIGN PATENT DOCUMENTS

| | | | |
|---|---|---|---|
| JP | 27061 | * | 1/1990 |

* cited by examiner

*Primary Examiner*—Alvin Chin-Shue
(74) *Attorney, Agent, or Firm*—J. David Nelson

(57) ABSTRACT

A buried pipeline construction laser alignment survey platform mountable on manhole sections. The platform has a platform deck and two opposing sets of foldable handrail mounted on the perimeter of the platform deck which are inter-connected by safety chains to complete a safety perimeter. A manhole access in the platform deck has a slideable access cover providing for a closed set-up position, an open access position, and a partially open laser alignment position. One or more sets of anchor pedestals on the bottom of the platform deck provide for securing the platform to manhole sections of one or more diameters.

29 Claims, 8 Drawing Sheets

PIPELINE CONSTRUCTION SAFETY PLATFORM

FIELD OF THE INVENTION

This invention is in the field of pipeline construction safety devices and in particular the field of pipeline alignment instrumentation platforms for underground pipeline construction.

BACKGROUND OF THE INVENTION

The construction of underground pipelines, and in particular the construction of pipelines for the non-pressurized, gravity flow of wastewater with suspended solids, such as sanitary sewers and storm sewers, requires tight alignment and slope control. Such pipelines are typically constructed with a uniform pipe diameter, uniform slope and uniform alignment between manholes, with slope changes and alignment changes occurring at manholes only. The manholes are used for access for inspection, maintenance and cleaning of the pipeline. The uniform slope and alignment between manholes provides for the free flow of the waste water with the solids remaining in suspension and not settling out in the pipeline.

Modern construction techniques for such pipelines utilize a construction laser which emits a pinpoint laser beam on a selected alignment and slope for alignment and slope control as the pipeline is laid. The laser is simply mounted in the bottom of the manhole from which the next segment of pipeline is to be constructed. The laser must be adjusted to emit the laser beam on the alignment and with the slope desired for the construction of the next segment of pipeline which connects to the manhole. The horizontal alignment of the laser beam must be set based on reference to survey markers in place on the surface of the ground. While the construction lasers are self-leveling and therefore provide for simply dialing in the desired slope, the alignment of the laser must be surveyed in by reference to survey markers on the surface. The most commonly used method for aligning the laser is to position a surveying instrument known as a transit directly over the laser with the transit being above the surface of the ground with the survey markers in view. The transit can then be set on the proper alignment for the pipeline. With the pipeline trench dug away from the manhole a few feet thereby allowing the laser beam to be directed roughly in the direction of the desired pipeline alignment, the transit is rotated vertically from the desired alignment and the laser beam alignment is adjusted to match the alignment established by the transit. Thereafter, depending upon the soil conditions, the alignment can be checked as the pipe sections are laid and minor adjustments can be made to the laser alignment as the pipeline construction proceeds further away from the manhole. This can continue only so long as the pipe trench is not back filled as trench back filling will obstruct the view of the laser beam through the transit.

The manholes for sanitary sewer and storm sewer lines are generally constructed from pre-formed circular manhole sections which have an inside diameter of 4 feet, 5 feet or more. These manhole sections, which are usually several feet in height are stacked one upon the other on top of a manhole base. The number of manhole sections is dependent upon the depth of the pipeline at the manhole location. On top of the circular manhole sections, a manhole cone narrows the diameter of the manhole down to 2 ½ or 3 feet typically. On top of the cone, manhole rings are used to bring the manhole to the desired finish elevation, where the manhole cover is installed.

During the pipeline construction, typically the manhole sections are placed for a manhole up to the level where the cone would be installed. At this point, the transit that is used to align the laser for the next section of pipe is perched on tope of the manhole sections. This is accomplished by spreading the legs of the transit tripod placing them on top of the top manhole section, or placing a board or some other standing surface on top of the top manhole section, leaving an opening for the proper positioning of the transit over the laser. The transit operator is standing on some board on top of the manhole section at great safety risk to himself and others including particularly the workmen inside the manhole to adjust the laser.

An apparatus is needed that will improve efficiency and safety of the construction laser alignment procedure. Despite the inefficiency and obvious safety deficiencies of commonly used procedures, Applicant has found no prior art devices that are designed to address this need. U.S. Pat. No. 5,787,955 and U.S. Pat. No. 5,265,974 to Dargie disclose a safety net for a ground level hatch frame opening. U.S. Pat. No. 4,960,150 discloses a safety cover movable deck on tracks and rollers.

The objective of the present invention is to provide a movable platform which is mountable on the top of a manhole pipe section, providing a safer working surface for workmen for accessing the manhole to set up a pipeline construction laser and for setting up and operating surveying instruments for aligning the construction laser with the desired pipeline alignment.

SUMMARY OF THE INVENTION

The present invention is a safety platform for which a preferred embodiment comprises a platform deck, one set of four internal anchor pedestals for anchoring to the inside wall of a small diameter manhole section, another set of four external anchor pedestals for anchoring to the outside wall of a larger diameter manhole section, two opposing pairs of folding handrails with handrail anchor brackets securing the handrail sections to the platform deck, and four sets of safety barrier chains. For preferred embodiments, the platform deck is constructed of grating trimmed with structural angle. However, the platform deck can be constructed of plate material. Grating or plate material can be metallic, such as steel or aluminum, or non-metallic, such as fiberglass. The platform deck has an access opening which is likewise trimmed with structural angle to provide smooth edges for persons using the access opening. The access opening is positioned in the platform deck such that when the platform is positioned on the manhole the access opening outside edge is over the manhole inside wall and the manhole rungs, if there are any. This promotes easy access to the manhole from the platform deck and easy exit from the manhole to the platform deck. A pair of access cover rails is attached to the platform deck bottom, the access cover rail length typically being approximately twice the width of the access opening to allow for the access opening cover to be slid completely under the platform deck to an access position which provides for the access opening to be completely opened. Rail stop plates on each ends of the access cover rails confines the access cover to the access cover rails. Alternatively, tabs or other mechanisms can be used to confine the access cover to the rails. The distance between the access cover rails will generally be approximately equal to the length of the access opening since the length and width of the access cover will generally be approximately equal to the length and width of the access opening. This provides for a complete closure of the access opening when the access cover is in the closed position. A lock pin inserted through an upper lock pin opening in an upper lock pin collar, through the access cover and through a lower lock and opening in the lower lock pin collar secures the access cover in the fully closed or partially closed position. The upper lock panel collar and lower lock pin collar are welded to the top and bottom respectively of the access opening frame. A first handrail section and a second handrail section are anchored on opposing sides of the platform deck. The first handrail section is anchored to the platform deck by a pair of first handrail anchor brackets and the second handrail section is anchored to the platform deck by a pair of second handrail anchor brackets. The first handrail section and the second handrail section respectfully are secured in the upright position by a handrail lock pin inserted in anchor bracket lock pin holes in opposing anchor bracket side walls and handrail lock pin holes in opposing sides of each handrail post, the anchor bracket lock pin holes and the handrail lock pin holes have been aligned when the handrail is in the upright position a kick tab on the inside face of each anchor bracket prevents each bottom of each handrail post from rotating inward and hence the top of the handrail from rotating outward, hence providing stability to the handrail in the upright position with the locking pins in place.

The third handrail section and a fourth handrail section are likewise anchored on opposing sides respectively of the platform deck. The third handrail section and fourth handrail section are perpendicular to the first handrail section and the second handrail section. Handrail sections three and four lay flat on top of handrail sections one and two when the handrail sections are retracted to the transport position.

With the handrail sections all in the upright position the perimeter safety chains are connected between the respective handrail sections thereby creating a safety barrier completely around the perimeter of the platform deck. The perimeter safety chains are connected at each end to the outside edge of the handrail section by a chain bracket. Generally for enhanced safety, an upper perimeter safety chain and a lower perimeter safety chain are used between adjacent handrail sections.

The platform may also be equipped with optional features such as the lifting chain storage box built into the platform deck and typically equipped with a hinged cover. A section of the hinged lifting chain storage box cover may also be equipped with a battery anchor bracket which allows a battery to be secured to the platform deck for use in powering the pipeline construction laser as well as lighting or ventilation for use in the manhole or on the platform.

The present invention shown has two sets of anchor pedestals, a set of four interior anchor pedestals and a set of four exterior anchor pedestals. The two sets of anchor pedestals provide for the utilization of the platform on two different sizes of manholes. Screw anchors extend from the anchor pedestals to secure the platform to the manhole.

DETAILED DESCRIPTION OF PREFERRED EMBODIMENTS

Figure 1:
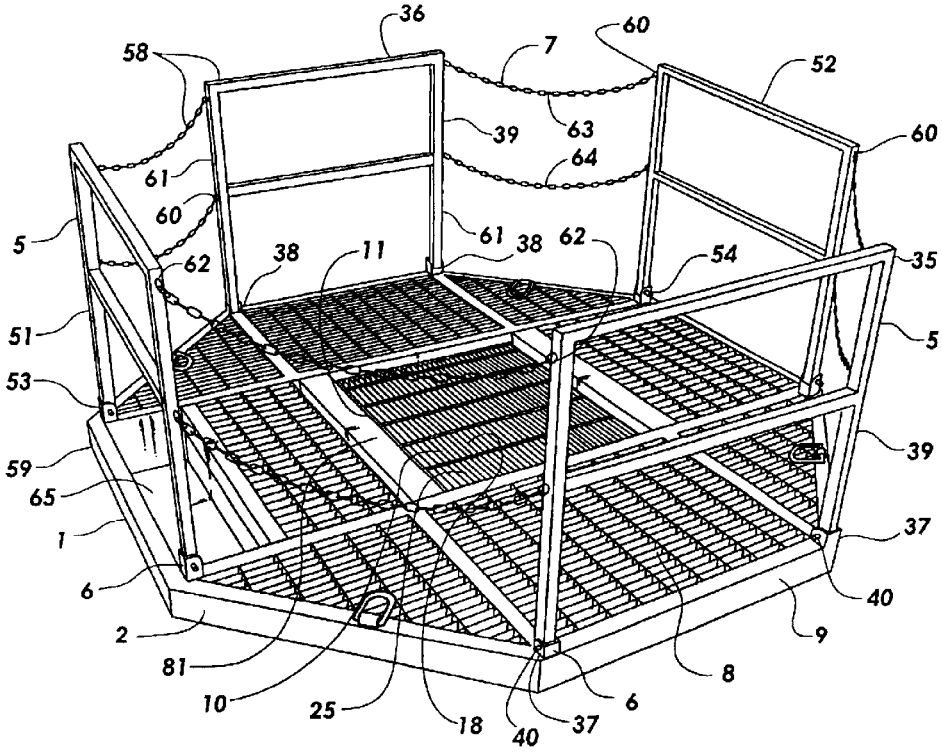
FIG. 1 is a perspective top view of a preferred embodiment of the safety platform of the present invention with handrail sections in the upright position.
Figure 6:
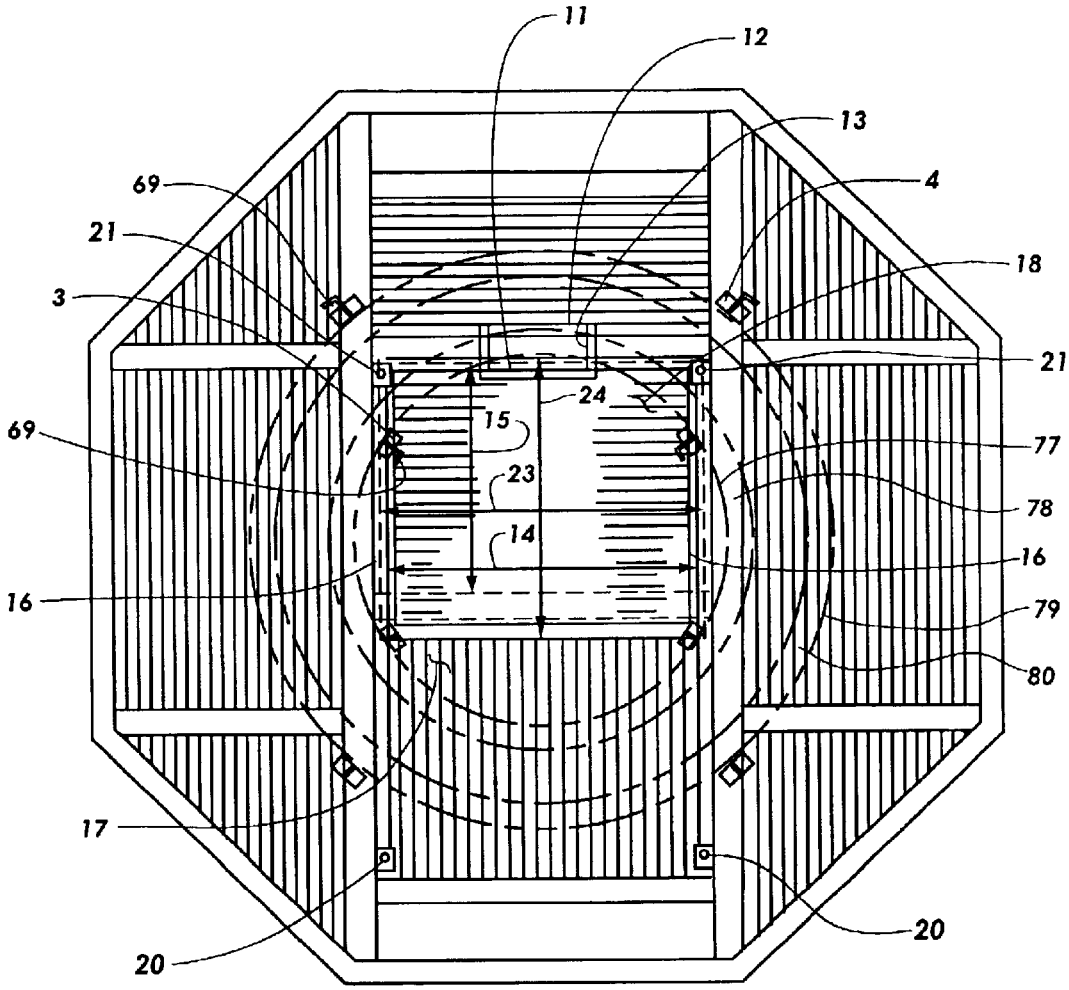
FIG. 6 is a top view of a preferred embodiment of the platform deck of the present invention, with anchor pedestal layout.

Referring first to FIG. 1, this preferred embodiment of the safety platform 1 of the present invention shown comprises a platform deck 2, two opposing pairs of folding handrails 5 affixed to the platform deck by handrail anchor brackets 6, four sets of safety barrier chains 7, and, referring now also to FIG. 6, one set of four internal anchor pedestals 3, for anchoring to the inside wall 77 of a smaller diameter manhole section 78, another set of four external anchor pedestals 4 for anchoring to the outside wall 79 of a larger diameter manhole section 80. For the embodiment shown in FIG. 1 the platform deck is constructed of grating 8 trimmed with structural angle 9. However, for other embodiments, the platform deck may be constructed of plate material. For those embodiments, the plate will likewise preferably be trimmed with structural angle to improve structural stability. The grating or plate may be made of steel, aluminum, fiberglass or other common structural materials.

Figure 4:
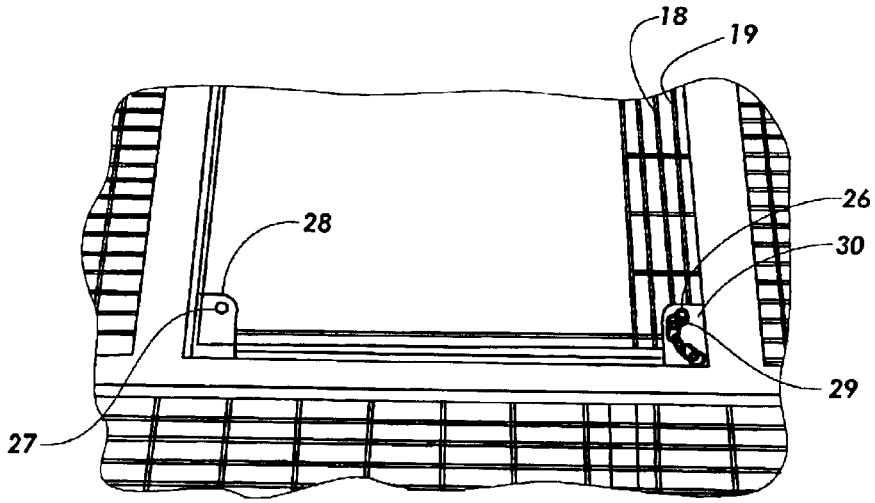
FIG. 4 is a perspective top view of the access opening with access cover in the open, access position and secured with lock pin in lock pin bracket.

The platform deck has an access opening 10 which for this preferred embodiment is likewise trimmed with structural angle 81 to provide smooth edges for those using the access opening. Referring again to FIG. 6, for this embodiment the access opening is positioned in the platform deck so that when the platform is placed on the manhole section, the access opening outside edge 11 is over the manhole inside wall 12 and the manhole rungs 13, if there are any. This promotes easy access to the manhole from the platform deck and easy exit from the manhole to the platform deck. The access opening width 14 and access opening length 15 are selected to allow ease of access to and from the manhole. A pair of access cover rails 16 is attached to the platform deck bottom 17. For this embodiment the access cover rails are constructed of structural angle. Referring also to FIG. 4, the access cover rail length is typically approximately twice the width of the access opening to allow for the access opening cover 18 to be slid mostly or completely under the platform deck to the access position 19 which provides for the access opening to be open. Rail stop plates 20 on each end 21 of the access cover rails confines the access cover to the access cover rails. Alternatively, tabs or other mechanisms can be used to confine the access cover to the rails. The distance 22 between the access cover rails will generally be approximately equal to the length of the access opening since the length 23 and width 24 of the access cover will generally be approximately equal to the length and width of the access opening. This provides for a complete closure of the access opening when the access cover is in the closed position 25.

Figure 3:
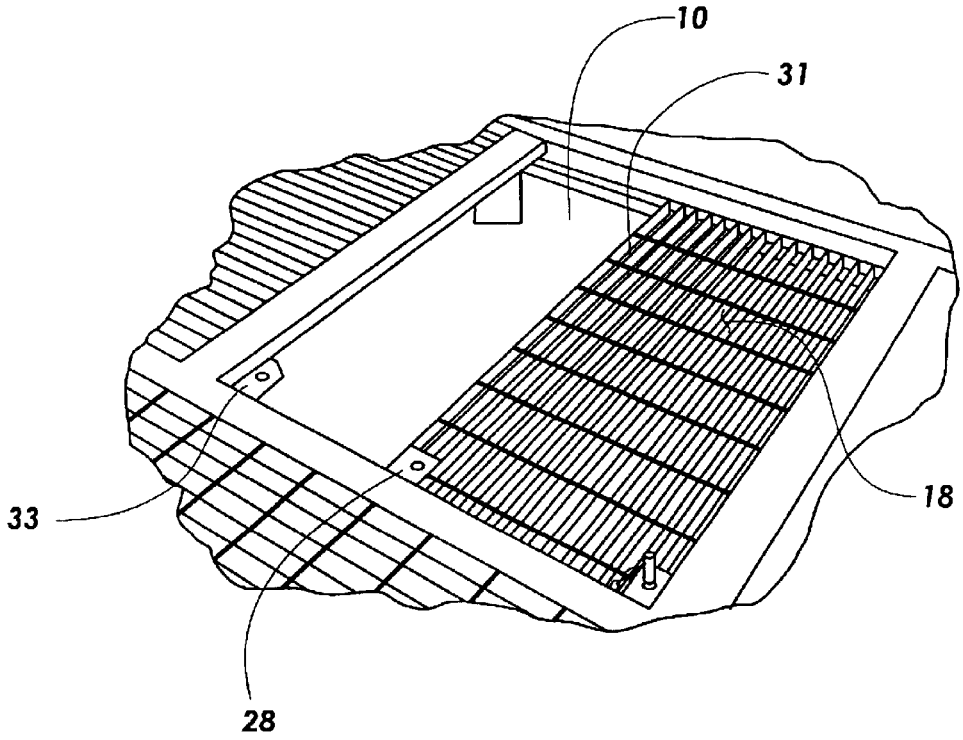
FIG. 3 is a perspective top view of the access opening with access cover in the partially open, laser alinement position.
Figure 5:
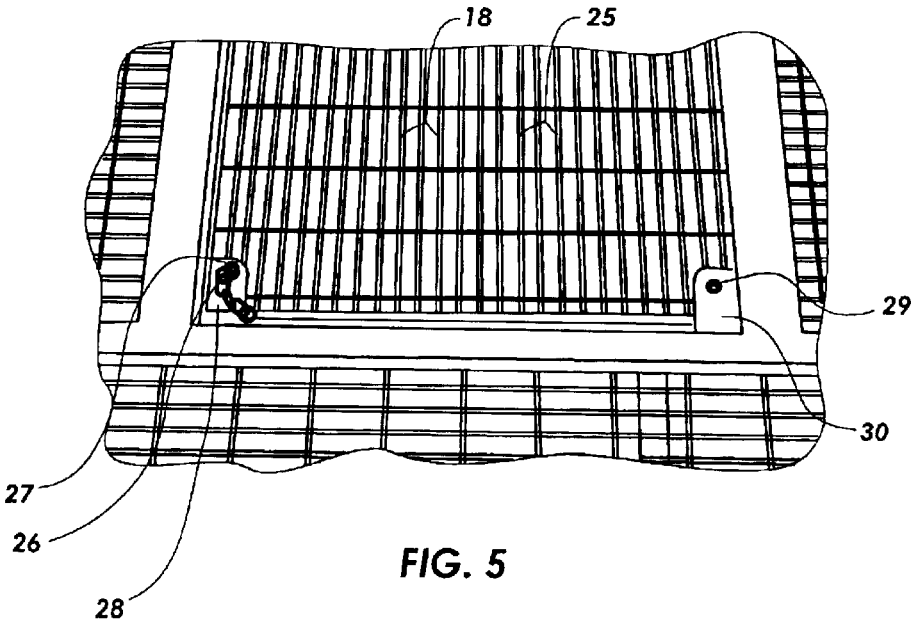
FIG. 5 is a perspective top view of the access opening with access cover in the closed, safety position and secured with lock pin in lock pin bracket.

Referring to FIG. 4 and FIG. 5, a lock pin 26 inserted through a first lock pin opening 27 in first lock pin collar 28 and into the access cover grating secures the access cover in the closed position 25. A lock pin inserted through a second lock pin opening 29 in a second lock pin collar 30 and into the access cover grating secures the access cover in the access position 19. A lock pin inserted through the second lock pin opening in the second lock pin collar and into the access cover grating with the access cover in a partially open, laser alignment position 31 as shown in FIG. 3. The first lock pin collar and the second lock pin collar, are welded to the the access opening frame 33. A lock pin tether 34, as shown in FIG. 4 and FIG. 5, may be used to keep the lock pin handy for use at all times.

Figure 7:
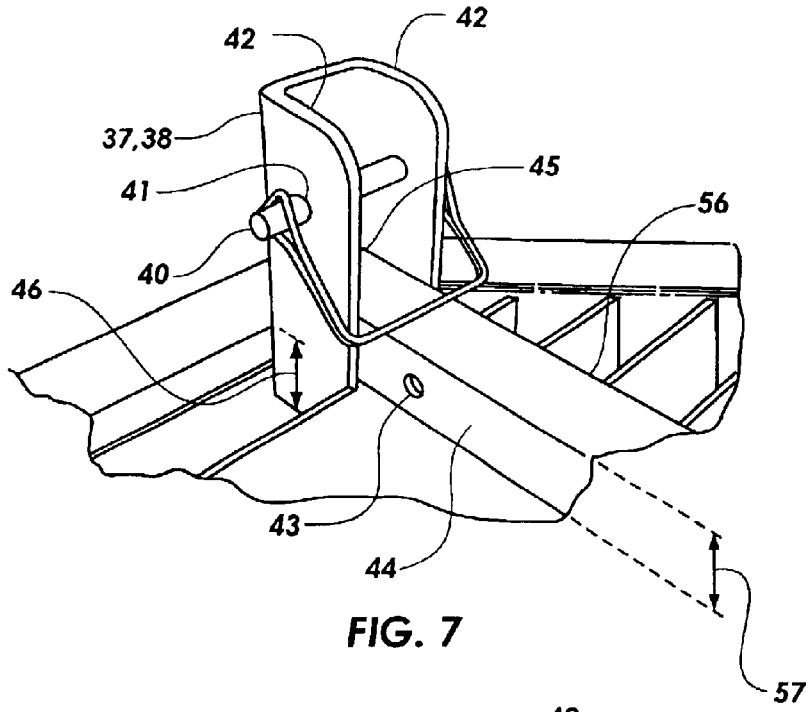
FIG. 7 is a perspective detail of first handrail anchor bracket.
Figure 8:
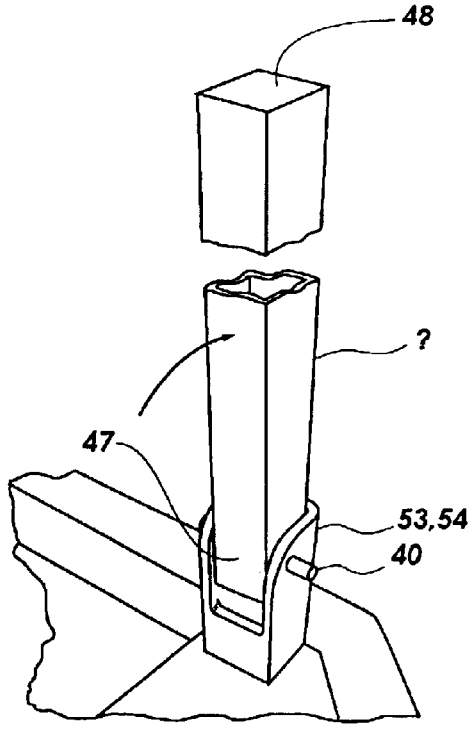
FIG. 8 is a perspective detail of a third handrail anchor bracket with handrail in the upright position.

Referring again to FIG. 1, a first handrail section 35 and a second handrail section 36 are anchored on opposing sides of the platform deck. The first handrail section is anchored to the platform deck by a pair of first handrail anchor brackets 37 and the second handrail section is anchored to the platform deck by a pair of second handrail anchor brackets 38. Referring now to FIG. 7 and FIG. 8, the first handrail section and the second handrail section respectfully are secured in the upright position 39 by a handrail lock pin 40 inserted in anchor bracket lock pin holes 41 in opposing anchor bracket side walls 42 and handrail lock pin holes 43 in opposing sides of each handrail post 44, the anchor bracket lock pin holes and the handrail lock pin holes being aligned for the insertion of the handrail lock pin as shown in FIG. 8. When the handrail is in the upright position the bottom 45 of each handrail post extends downward into the anchor bracket recess 46, which prevents the bottom of the handrail post from rotating inward 47 and hence the top 48 of the handrail from rotating outward 49, thereby providing stability to the handrail in the upright position with the handrail lock pins in place.

Figure 9:
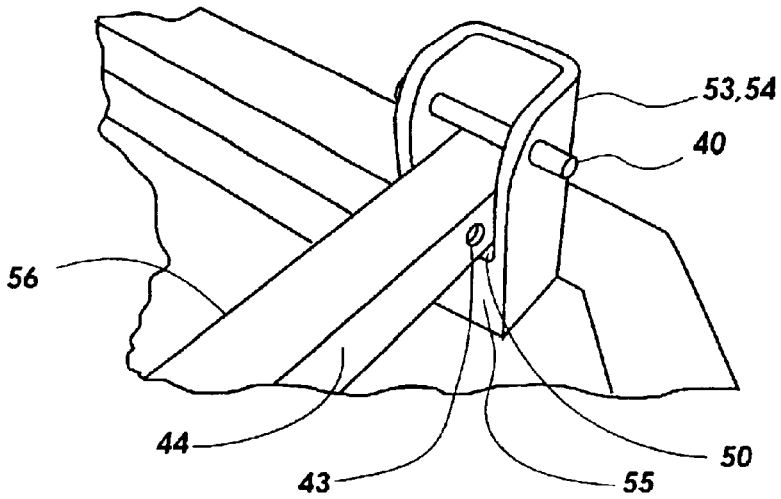
FIG. 9 is a perspective detail of a third handrail anchor bracket with handrail in the transport position.

A third handrail section 51 and a fourth handrail section 52 likewise are anchored on opposing sides respectively of the platform deck. The third handrail section and fourth handrail section are perpendicular to the first handrail section and the second handrail section for the embodiment shown in FIG. 1. A pair of third handrail anchor brackets 53 secures the third handrail section and a pair of fourth handrail anchor brackets 54 secures the fourth handrail section to the platform deck. For the embodiment shown in FIG. 1, the third handrail anchor brackets and the fourth handrail anchor brackets, which are shown in FIG. 9, are identical and the only difference between these handrail anchor brackets and the first or second handrail anchor brackets is that the third and fourth anchor brackets have bracket tabs 50 in the front face 55 of the brackets. For the embodiment shown in FIG. 1, when the handrail locking pins are removed and the handrail is lowered to the handrail transport position 56 as shown in FIG. 2 and in FIG. 7 and FIG. 9, the bracket tabs on the third and fourth handrail anchor brackets provide that, the handrail sections three and four will lay flat on top of handrail sections one and two, the height of the bracket tab being equal to the thickness 57 of the handrail.

Referring again to FIG. 1, with the handrail sections one, two, three and four in the upright position, the safety barrier chains 7 are connected between the respective handrail sections thereby creating a safety barrier 58 completely around the perimeter 59 of the platform deck. The safety barrier chains are connected at each end 60 to the outside edge 61 of a handrail section by a chain bracket 62. Generally for enhanced safety, an upper safety chain 63 and a lower safety chain 64 are used between adjacent handrail sections. Other types of removable barrier elements may also be used between the handrail sections which will be known by persons skilled in the art.

Figure 2:
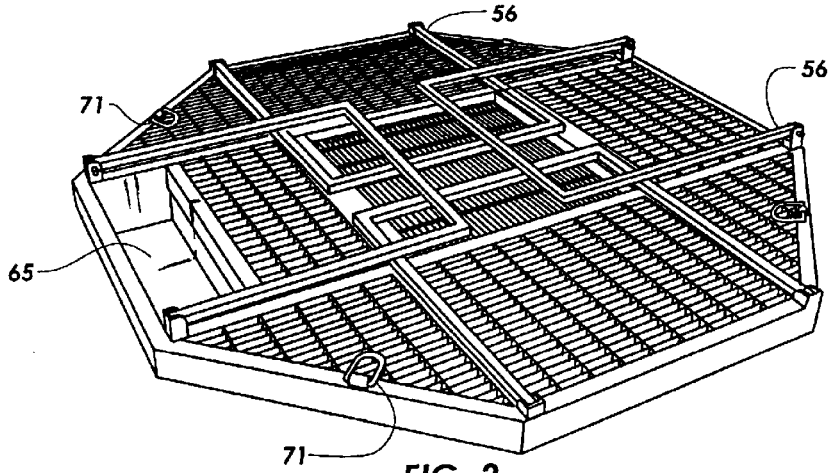
FIG. 2 is a perspective top view of a preferred embodiment of the safety platform of the present invention with handrail sections in the transport position.
Figure 10:
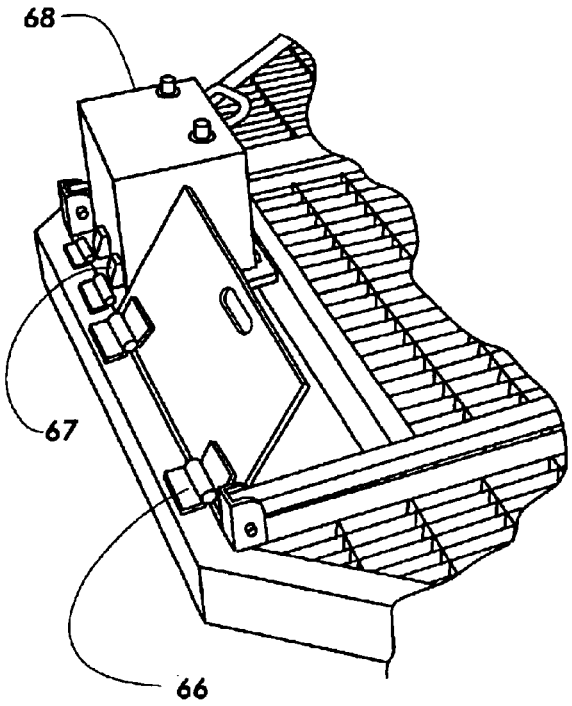
FIG. 10 is a perspective top view of an embodiment of the chain storage box and storage box cover with battery bracket.
Figure 13:
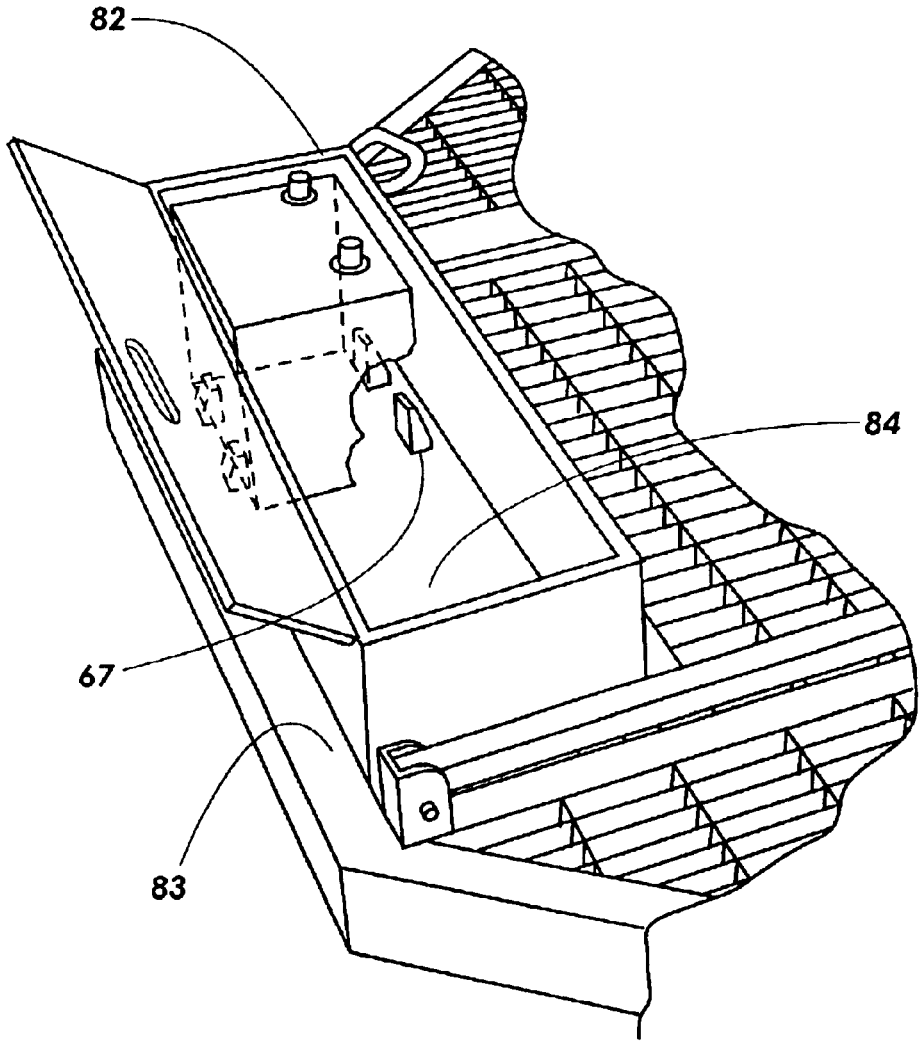
FIG. 13 is perspective top view of a chain storage box extended above the platform deck with battery bracket mounted in the chain storage box.

The safety platform of the present invention may also be equipped with optional features such as a lifting chain storage box 65 shown in FIG. 1 and FIG. 2, which may inset into the platform deck, and lift rings 71 which are attached to the platform deck at the perimeter. The storage box may be equipped with a hinged chain storage box cover 66 as shown in FIG. 10. A section of the chain storage box cover may also be equipped with a battery anchor bracket 67 which allows a battery 68 to be secured to the platform deck for use in powering the pipeline construction laser as well as lighting or ventilation in the manhole or lighting for the platform. Alternatively, the top 82 of the chain storage box may extend above the top 83 of the platform deck as shown in FIG. 13, the depth of the chain storage box providing for the battery to be mounted and stored in the chain storage box with the battery anchor bracket 67 secured to the bottom 84 of the chain storage box. The lift rings are preferably equally spaced around the perimeter of the platform deck. The embodiment shown in FIG. 1 and FIG. 2 has four lift rings. At least three lift rings are ordinarily used in order to provide for stability in handling the safety platform.

Referring again to FIG. 6, the embodiment of the present invention shown has two sets of anchor pedestals, a set of four interior anchor pedestals 3 and a set of four exterior anchor pedestals 4. The two sets of anchor pedestals provide for the utilization of the platform on two different sizes of manholes. For instance, the common inside diameter for sanitary sewer manholes is four feet. A less common but occasionally used inside diameter for sanitary sewers is six feet. The configuration of anchor pedestals shown in FIG. 6 works well for four foot and six foot diameter manhole combination. The interior set of four anchor pedestals fit inside of and provide for the centering of the platform on a four foot diameter manhole. Screw anchors 69 are extended from two of the interior pedestals to the inside wall 77 of the smaller diameter manhole 78 to secure the platform to the manhole. For the larger diameter manhole 80, screw anchors are extended from two of the exterior pedestals to the outside wall 79 of the manhole.

Figure 11:
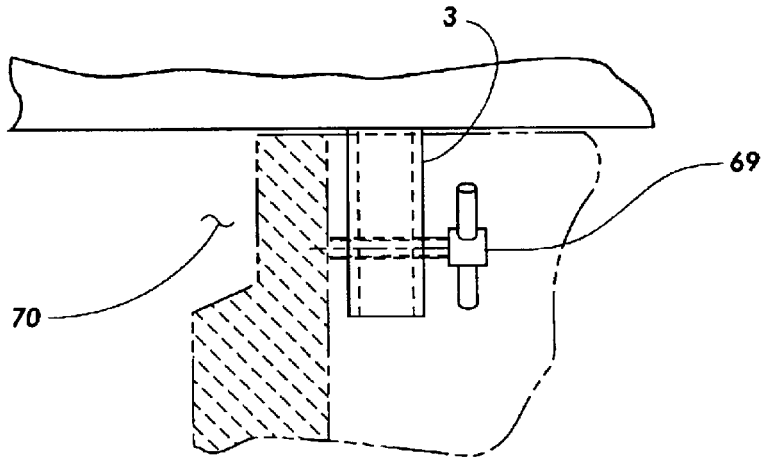
FIG. 11 is an elevation detail of inside anchor pedestals of the present invention.
Figure 12:
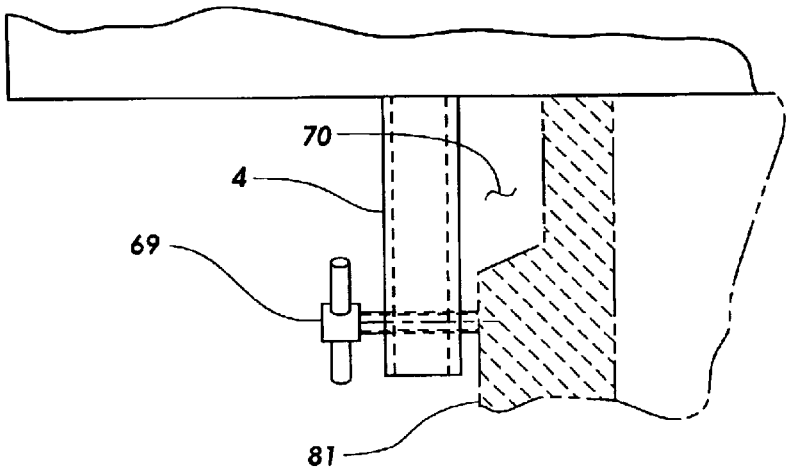
FIG. 12 is an elevation detail of outside anchor pedestals of the present invention.

For this embodiment the set of four exterior anchor pedestals 4, which are illustrated in FIG. 12, are longer than the four interior anchor pedestals 3, which are illustrated in FIG. 11, because the exterior anchor pedestals must fit on the outside 81 of the manhole section. Since the manhole sections typically have the side with the exterior joint groove oriented up, the anchor pedestals must extend below the exterior groove 70 as shown in FIG. 12. The screw anchors extend inwardly from two of the exterior anchor pedestals to the exterior surface of the manhole section below the joint groove in the top of the manhole section. While the embodiment shown utilizes four pedestals to position and secure the safety platform to a manhole, a three pedestal set could be used effectively, with only one of the pedestals having a screw anchor.

Other embodiments of the invention and other variations and modifications of the embodiments described above will be obvious to a person skilled in the art. Therefore, the foregoing is intended to be merely illustrative of the invention and the invention is limited only by the following claims.

What is claimed is:

1. Buried pipeline construction laser alignment survey platform comprising:

a) platform deck constructed of grating, the platform deck having an access opening and a slideable access cover, the access cover being slidably affixed to the platform and slides under the platform deck on slide rails attached to the bottom of the platform deck, the access cover being slideable and securable to a closed set-up position, an open access position, and a partially open laser alignment position;

b) anchor means for positioning the platform on top of a manhole section and for securing the platform to the manhole section;

c) safety barrier means for providing a worker safety barrier at the perimeter of the platform deck; and d) access cover locking means affixed to the platform deck and securing the access cover in the open, closed and partially open positions by insertion of the locking means through aligned openings in the platform deck and access cover.

2. Buried pipeline construction laser alignment survey platform as recited in claim 1 wherein the safety barrier means comprises a plurality of foldable handrail sections affixed to the platform deck and a plurality of interconnecting removable barrier elements affixed between adjacent handrail sections.

3. Buried pipeline construction laser alignment survey platform as recited in claim 1 further comprising a plurality of lift rings attached to the perimeter of the platform deck.

4. Buried pipeline construction laser alignment survey platform as recited in claim 1 wherein the access cover locking means comprises one or more lock pin collars affixed to the platform deck at the access opening and one or more lock pins.

5. Buried pipeline construction laser alignment survey platform as recited in claim 1 further comprising a lifting chain storage box inset in the platform deck.

6. Buried pipeline construction laser alignment survey platform as recited in claim 5 further comprising a hinged cover on the lifting chain storage box.

7. Buried pipeline construction laser alignment survey platform as recited in claim 6 further comprising a battery holder affixed to the hinged cover.

8. Buried pipeline construction laser alignment survey platform as recited in claim 2 wherein the foldable handrail sections are affixed to the platform deck with a plurality of handrail anchor brackets.

9. Buried pipeline construction laser alignment survey platform as recited in claim 8 wherein there are two pairs of opposing handrail sections, a pair of first handrail sections and a pair of second handrail sections affixed to the platform deck by a first pair of handrail anchor brackets and a second pair of handrail anchor brackets respectively, one the pairs of handrail anchor brackets having a bracket tab in the front face of each of the handrail anchor brackets.

10. Buried pipeline construction laser alignment survey platform as recited in claim 1 further comprising one or more grating plate affixed to the bottom of grating to prevent over penetration of survey instrument tripod legs through the grating.

11. Buried pipeline construction laser alignment survey platform as recited in claim 1 wherein the anchor means comprises a plurality of anchor pedestals affixed to and extending below the platform deck.

12. Buried pipeline construction laser alignment survey platform as recited in claim 11 wherein the number of anchor pedestals is three or more.

13. Buried pipeline construction laser alignment survey platform as recited in claim 11 wherein the number of anchor pedestals is four or more.

14. Buried pipeline construction laser alignment survey platform as recited in claim 11 wherein there are two sets of anchor pedestals, a first set of three or more anchor pedestals for positioning on the inside of a smaller diameter manhole section and a second set of three or more anchor pedestals for positioning on the outside of a larger diameter manhole section, thereby allowing for the use of the platform with two sizes of manhole sections.

15. Buried pipeline construction laser alignment survey platform as recited in claim 11 wherein one or more of the anchor pedestals has a screw anchor for securing the platform to the manhole section.

16. Buried pipeline construction laser alignment survey platform comprising:

a) platform deck constructed of grating, the platform deck having an access opening and a slideable access cover, the access cover being slidably affixed to the platform and slides under the platform deck on slide rails attached to the bottom of the platform deck, the access cover being slideable and securable to a closed set-up position, an open access position, and a partially open laser alignment position;

b) plurality of anchor pedestals affixed to the bottom of the platform deck and extending below the platform deck at locations providing for positioning of the platform on top of a manhole section, one or more of the anchor pedestals having means for anchoring the platform to the manhole;

c) perimeter safety barrier; and d) access cover locking means affixed to the platform deck and securing the access cover in the open, closed and partially open positions by insertion of the locking means through aligned openings in the platform deck and access cover.

17. Buried pipeline construction laser alignment survey platform as recited in claim 16, wherein the perimeter safety barrier comprises a plurality of foldable handrail sections and interconnecting removable barrier elements affixed between adjacent handrail sections.

18. Buried pipeline construction laser alignment survey platform as recited in claim 16 further comprising a plurality of lift rings attached to the perimeter of the platform deck.

19. Buried pipeline construction laser alignment survey platform as recited in claim 16 wherein the access cover locking means comprises one or more lock pin collars affixed to the platform deck at the access opening and one or more lock pins.

20. Buried pipeline construction laser alignment survey platform as recited in claim 16 further comprising a lifting chain storage box inset in th platform deck.

21. Buried pipeline construction laser alignment survey platform as recited in claim 20 further comprising a hinged cover on the lifting chain storage box.

22. Buried pipeline construction laser alignment survey platform as recited in claim 21 further comprising a battery holder affixed to the hinge cover.

23. Buried pipeline construction laser alignment survey platform as recited in claim 17 wherein the foldable handrail sections are affixed to the platform deck with a plurality of handrail anchor brackets.

24. Buried pipeline construction laser alignment survey platform as recited in claim 23 wherein there are two pairs of opposing handrail sections, a pair of first handrail sections and a pair of second handrail sections affixed to the platform deck by a first pair of handrail anchor brackets and a second pair of handrail anchor brackets respectively, one the pairs of handrail anchor brackets having a bracket tab in the front face of each of the handrail anchor brackets.

25. Buried pipeline construction laser alignment survey platform as recited in claim 16 further comprising one or more grating plates affixed to the bottom of grating to prevent over penetration of survey instrument tripod legs through the grating.

26. Buried pipeline construction laser alignment survey platform as recited in claim 16 wherein the number of anchor pedestals is three or more.

27. Buried pipeline construction laser alignment survey platform as recited in claim 16 wherein the number of anchor pedestals is four or more.

28. Buried pipeline construction laser alignment survey platform as recited in claim 16 wherein there are two sets of anchor pedestals, a first set of three or more anchor pedestals for positioning on the inside of a smaller diameter manhole section and a second set of three or more anchor pedestals for positioning on the outside of a larger diameter manhole section, thereby allowing for the use of the platform with two sizes of manhole sections.

29. Buried pipeline construction laser alignment survey platform as recited in claim 16 wherein one or more of the anchor pedestals has a screw anchor for securing the platform to the manhole section.

* * * * *